United States Patent [19]

Green et al.

[11] Patent Number: 4,617,684

[45] Date of Patent: Oct. 21, 1986

[54] PROTECTIVE PALM-PAD

[76] Inventors: Paul G. Green, P.O. Box 9554, Phoenix, Ariz. 85068; Gregory C. Gayne, 4929 W. Hatcher Rd., Glendale, Ariz. 85302

[21] Appl. No.: 302,508

[22] Filed: Sep. 16, 1981

[51] Int. Cl.[4] ..... A41D 13/00

[52] U.S. Cl. ..... 2/20; 2/16; 2/19

[58] Field of Search ..... 2/20, 16, 19; 15/209, 15/227

[56] References Cited

U.S. PATENT DOCUMENTS 690,302 12/1901 Lee ..... 2/20

3,735,442 5/1973 Lukas ..... 2/20

*Primary Examiner*—Doris L. Troutman

[57] ABSTRACT

A hand mounted player's protective palm pad has palm configured two piece pad and two fastening loops secured to the pad, one small loop and one much larger. The one small loop encircles the base of the user's forefinger; the much larger loop extends about the back of the user's hand. These two loops hold the player's protective palm pad constantly and securely in the desired position on the user's palm, remote from the user's thumb. In other embodiments the pad can be made larger or smaller; the comfiguration can be made different to provide more palm or finger protection; additional finger loops and/or hand loops may be secured to the pad; and the protective palm pad can be made to be worn on either hand.

6 Claims, 6 Drawing Figures

PROTECTIVE PALM-PAD

DESCRIPTION

THE DRAWING—FIGS. 1-6

The invention consists of a protective palm pad which is mounted securely on the user's hand and worn inside the user's baseball mitt or baseball glove yet leaving the user's hand free to perform and control the mitt or glove. This invention is concerned primarily as a shock absorbent player protective palm pad, but may be used for other purposes also.

Accordingly, the invention provides in the preferred embodiment a protective palm pad comprising a flexible facing pad of leather, and a backing pad of shock absorbent material which is secured to the user's hand by two loops, one loop encircling the base of the user's forefinger and a second larger loop extending about the back of the user's hand. These loops hold the protective palm pad constantly in the secure position desired by the user. Thus attached, the user's hand then is still free and independent to perform and to control the mitt or glove. The loops also permit the user to quickly and easily slip the protective palm pad on or off.

Reference is first made to FIGS. 2 to 5 which show a typical protective palm pad 10 according to the invention. The protective palm pad 10 comprises a flexible leather facing pad a palm-side pad 1 of shock absorbent material, a finger loop 3 of elastic tape, and a hand loop 4 of elastic tape. The protective palm pad 10 is oddly configured to protect the palm and finger knuckles.

Figure 6:
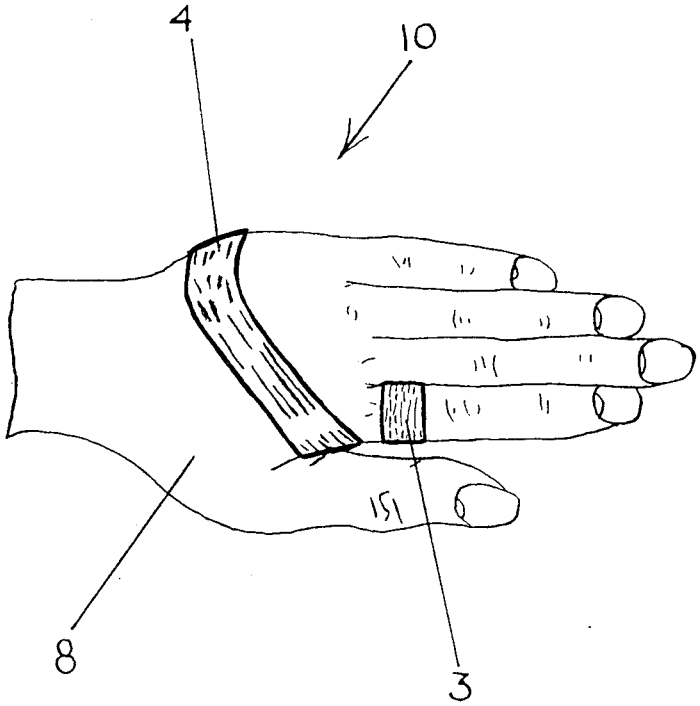
FIG. 6 is a view of the back of a user's hand with the protective palm pad secured to the finger and hand.

The two loops 3, 4 are provided to secure the protective palm pad 10 to the user's hand FIG. 6. The finger loop 3 positions and holds the protective palm pad 10 at the area of the user's hand where the greatest impact occurs and where the greatest impact occurs most often. The hand loop 4 positions and holds the protective palm pad 10 constantly tight to the user's palm permitting the user's hand to easily slip into and out of the user's glove or mitt, permitting the user's hand to be free and independent of the user's mitt or glove to function as desired, and permitting the user total control of the mitt or glove.

Figure 1:
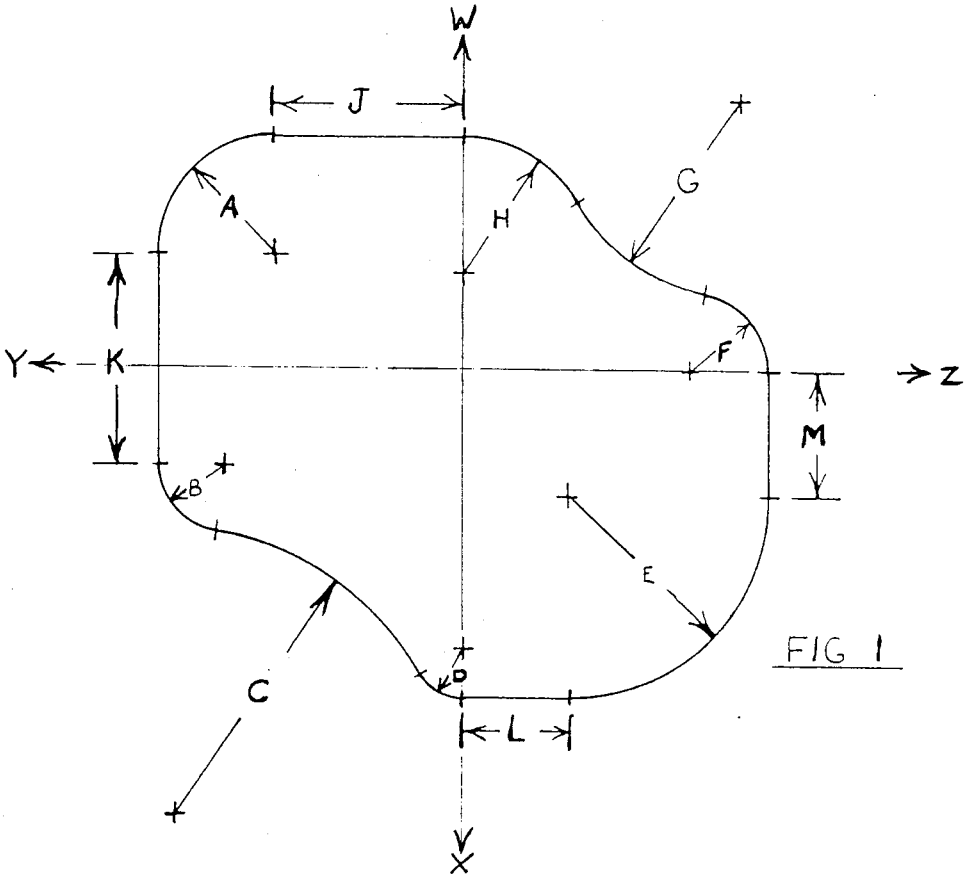
FIG. 1 is a front perspective view and the preferred pattern of a protective palm pad according to the invention. (Use of the pattern is compatible in right hand/left hand pad construction.) (For use on left hand.)
Figure 2:
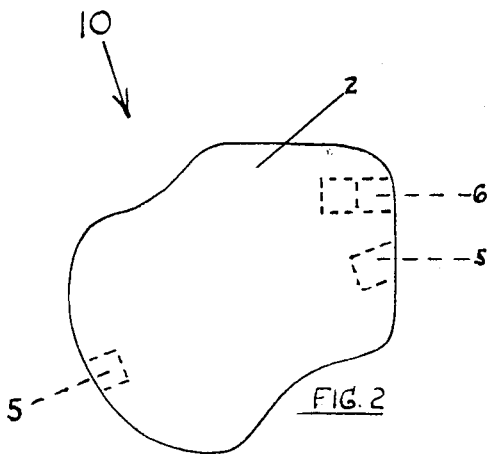
FIG. 2 is a front view of the protective palm pad of FIG. 1. (For use on right hand.)
Figure 3:
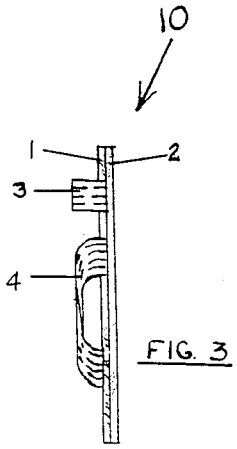
FIG. 3 is a side view of the protective palm pad of FIG. 1. (For use on left hand.)
Figure 4:
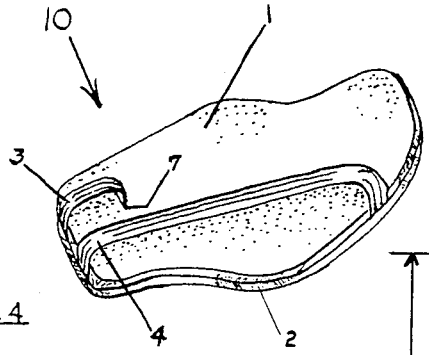
FIG. 4 is a backside view of the protective palm pad of FIG. 1. (For use on right hand.)

The leather facing pad 2 is a tough, durable, flexible abrasion resistant pad 2 which protects the shock absorbent material (rear) pad 1 from abrasion and stresses, and is the part of the protective palm pad to which the finger loop ends 6, FIG. 2 are adhered; to which the hand loop ends 5, FIG. 2 are adhered; and to which the shock absorbent material (rear) pad 1 is adhered 1, FIG. 3, and 1, FIG. 4.

Attention is directed, however, to the manner in which one end of the finger loop 3 is adhered to the leather facing pad 2. Referring to FIG. 4, a slit is cut through the shock absorbent material (rear) pad 1 and one end of the finger loop 3, 7 is drawn through and adhered to the back of the leather facing pad 2, and the opposite end of the finger loop 3 is attached as shown in 3, FIG. 3 and 3, FIG. 4.

The shock absorbent material (rear) pad 1 is adhered to the back of the leather facing pad 2. The shock absorbent (rear) pad 1 has the same odd configuration as the leather facing pad 2 and provides the user with a shock absorbing function and which also does not cause or let the baseball or softball rebound from the user's mitt or glove as does a compressible sponge or foam.

TABLE A—FIG. 1

(Tolerances of 1/16" plus or minus and 1° plus or minus.)

A. Apex at $1\frac{1}{4}$" left of line W, X and $\frac{3}{4}$" above line Y, Z and radius of $\frac{3}{4}$" from 360° to 270°.
B. Apex at 1 9/16" left of line W, X and $\frac{5}{8}$" below line Y, Z and radius of 7/16" from 270° to 189°.
C. Apex at $1\frac{7}{8}$" left of line W, X and 2 15/16" below line Y, Z and radius of $1\frac{7}{8}$" from 8° to 60°.
D. Apex on line W, X and 1 13/16" below line Y, Z and radius of 5/16" from 240° to 180°.
E. Apex at 11/16" right of line W, X and 13/16" below line Y, Z and radius of 1 5/16" from 180° to 90°.
F. Apex at $1\frac{1}{2}$" right of line W, X and on line Y, Z and radius of $\frac{1}{2}$" from 90° to 11°.
G. Apex at 1 13/16" right of line W, X and $1\frac{3}{4}$" above line Y, Z and radius of $1\frac{1}{4}$" from 191° to 239°.
H. Apex on line W, X and $\frac{5}{8}$" above line Y, Z and radius of $\frac{7}{8}$" from 48° to 0°.
J. $1\frac{1}{4}$"
K. $1\frac{3}{8}$"
L. 11/16"
M. 13/16"

TABLE B

Figure 5:
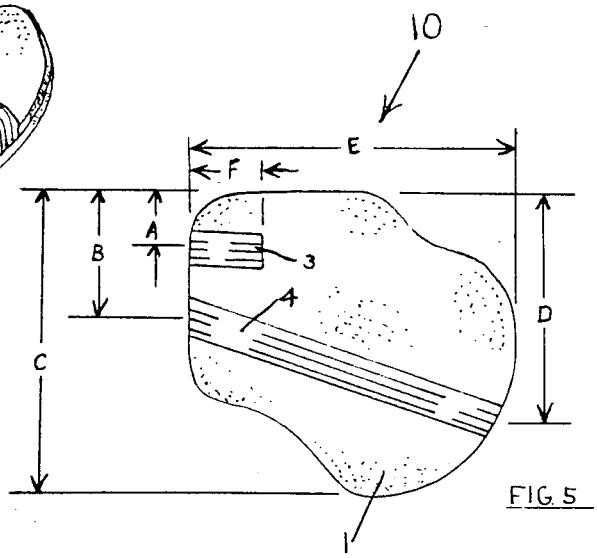
FIG. 5 is a backside view of the protective palm pad of FIG. 1. (For use on right hand.)

| | FIG. 5 | |
|---|---|---|
| | PREFERRED SIZE (INCHES) | PREFERRED RANGE (INCHES) |
| A. | $\frac{7}{8}$" | $\frac{1}{2}$"–$1\frac{3}{8}$" |
| B. | 1 15/16" | 1 9/16"–2 9/16" |
| C. | $3\frac{5}{8}$" | $2\frac{3}{4}$"–$4\frac{1}{2}$" |
| D. | $2\frac{3}{4}$" | $2\frac{1}{4}$"–$3\frac{1}{4}$" |
| E. | 4" | $3\frac{1}{4}$"–$4\frac{1}{2}$" |
| F. | $\frac{7}{8}$" | $\frac{5}{8}$"–$1\frac{1}{4}$" |

TABLE C

| | FIGS. 2, 3, 4, 5, 6 | |
|---|---|---|
| IDENTIFICATION | PREFERRED SIZE (INCHES) | PREFERRED RANGE (INCHES) |
| 1. SHOCK ABSORBENT MATERIAL (PALM SIDE) PAD | $\frac{1}{8}$" | 1/16"–$\frac{1}{4}$" |
| 2. LEATHER FACING PAD | $\frac{1}{8}$" | 1/16"–3/16" |
| 3. FINGER LOOP | LENGTH $2\frac{1}{4}$" VISIBLE<br>WIDTH $\frac{3}{8}$" | LENGTH 2"–$2\frac{1}{2}$"<br>WIDTH $\frac{1}{4}$"–$\frac{1}{2}$" |
| 4. HAND LOOP | LENGTH $4\frac{3}{4}$"VISIBLE | LENGTH $4\frac{1}{2}$"–$5\frac{1}{2}$" |

TABLE C-continued

| IDENTIFICATION | FIGS. 2, 3, 4, 5, 6 PREFERRED SIZE (INCHES) | PREFERRED RANGE (INCHES) |
|---|---|---|
| | WIDTH $\frac{3}{4}$" | WIDTH $\frac{5}{8}$"-$\frac{7}{8}$" |
| 5. ENDS OF HAND LOOP AS ADHERED INSIDE PAD | $\frac{1}{2}$" | $\frac{3}{8}$"-$\frac{5}{8}$" |
| 6. ENDS OF FINGER LOOP AS ADHERED INSIDE PAD | $\frac{5}{8}$" | $\frac{1}{2}$"-$\frac{3}{4}$" |
| 7. SLIT IN SHOCK ABSORBENT MATERIAL (PALM SIDE) PAD THROUGH WHICH ONE END OF FINGER LOOP PASSES | $\frac{3}{8}$" | $\frac{1}{4}$"-$\frac{1}{2}$" |
| 8. USER'S HAND | | |
| 10. THE INVENTION - THE PROTECTIVE PALM PAD | | |

Having previously described our invention, what we claim as new is:

1. A protective palm pad for the purpose already described comprising: an oddly configured pad of two flexible components, having a leather facing and a backing of shock absorbent material, and two loops for securing the protective palm pad to the user's hand, and said leather facing exposed and worn in contact with the inside of the user's baseball mitt or glove, and said shock absorbent material backing pad worn in contact with the user's palm, and said two loops, one worn at the base of the user's forefinger and the larger one worn extended about the back of the user's hand, said loops positioning and securing the protective palm pad to the user's hand.

2. A protective palm pad according to claim 1 wherein said pad in preferred embodiments is between $3\frac{1}{4}$ inches and $4\frac{1}{2}$ inches wide.

3. A protective palm pad according to claim 1 wherein said pad in preferred embodiments is between $2\frac{3}{4}$ inches and $4\frac{1}{2}$ inches long.

4. A protective palm pad according to claim 1 wherein said pad in preferred embodiments is between $\frac{1}{8}$ and $\frac{5}{8}$ inches thick.

5. A protective palm pad according to claim 1 wherein said pad in preferred embodiments has a finger loop of elastic tape $\frac{3}{8}$ inches wide, a visible length of $2\frac{1}{4}$ inches and a total length of $3\frac{1}{2}$ inches.

6. A protective palm pad according to claim 1 wherein said pad in preferred embodiments has a hand loop of elastic tape $\frac{3}{4}$ inches wide, a visible length of $4\frac{3}{4}$ inches and a total length of $5\frac{3}{4}$ inches.

* * * * *